US005964990A

United States Patent [19]

Muratori et al.

[11] Patent Number: 5,964,990

[45] Date of Patent: Oct. 12, 1999

[54] DEVICE FOR CLEANING METAL SURFACES

[75] Inventors: Stefano Muratori, Formigine; Michele Lapelosa, Castelfranco Emilia; Alessandro Alboni, Modena, all of Italy

[73] Assignees: Nitty-Gritty S.R.L., Formigine, Italy; Nitty-Gritty GmbH, Brunnen, Switzerland

[21] Appl. No.: 09/043,858

[22] PCT Filed: Aug. 27, 1996

[86] PCT No.: PCT/IT96/00165

§ 371 Date: May 26, 1998

§ 102(e) Date: May 26, 1998

[87] PCT Pub. No.: WO97/12081

PCT Pub. Date: Apr. 3, 1997

[30] Foreign Application Priority Data

Sep. 27, 1995 [IT] Italy ..... MO95A0131
Nov. 10, 1995 [IT] Italy ..... MO95A0156

[51] Int. Cl.[6] ..... C25F 7/00; C25D 17/14

[52] U.S. Cl. ..... 204/224 M; 204/271; 204/290 R; 204/284; 204/278; 204/283; 204/293; 204/294

[58] Field of Search ..... 204/224 M, 224 R, 204/271, 278, 290 R, 293, 294, 284, 283

[56] References Cited

U.S. PATENT DOCUMENTS 3,865,697 2/1975 Suggs ..... 204/271 X
4,431,501 2/1984 Leppanen ..... 204/271 X
4,495,045 1/1985 Jackson ..... 204/271 X
4,882,019 11/1989 Lewy ..... 204/271 X
4,992,154 2/1991 Ida et al. ..... 204/271 X
5,401,369 3/1995 Gershin ..... 204/271 X

*Primary Examiner*—Donald R. Valentine
*Attorney, Agent, or Firm*—Millen, White, Zelano & Branigan, P.C.

[57] ABSTRACT

The device proposed for cleaning metal surfaces consist of pad (12, 34, 91) of insulating material held between a beak-shaped (11, 52, 94) electrode (10, 26, 46) and the metal surface (8) to be cleaned, plus a low-voltage a.c. power supply (2) which is connected via the other electrode to the metal (7). A pump supplies the pad with a highly corrosive, high-density, acid solution. The pad consists of a relatively thick hose or tape. The device has slots (36) into which the gases and vapors produced during cleaning are drawn by an extractor fan (40) and then passed through a washing bottle (41) where they are cleaned. The electrode may have various shapes, and it is possible to replace the tip (28, 94, 98). The electrode is preferably designed with bores through which the acid solution can be fed. The main body (97) of the electrode and the replaceable tip (94, 98) may be coated with a layer (101, 100) of insulating material which prevents short-circuits occurring and concentrates the electrolytic action ant the end surface (102) of the electrode. Woven of felt fabric made of polyetheretherketone is preferably used as the insulating material of the pad. The lifetime and working capacity of the device are maximized by using a double-layer pad (92, 93), the inner layer being made of woven fabric (92) and the other layer of felt (93).

16 Claims, 5 Drawing Sheets

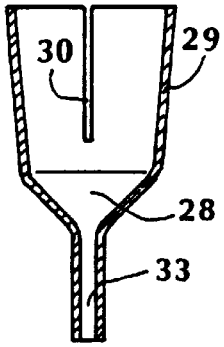
Fig.6
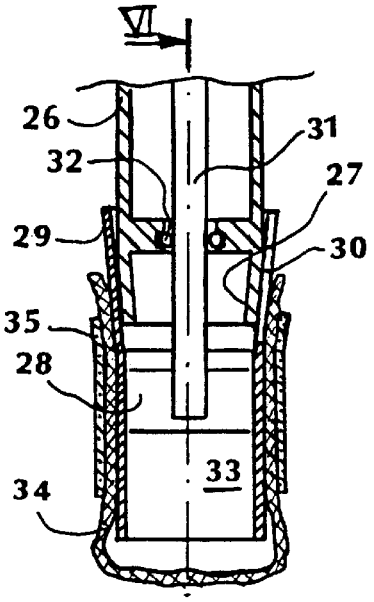
Fig.5
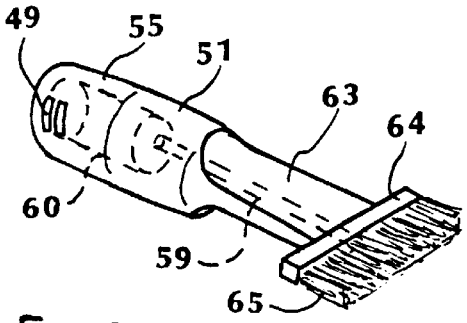
Fig.14
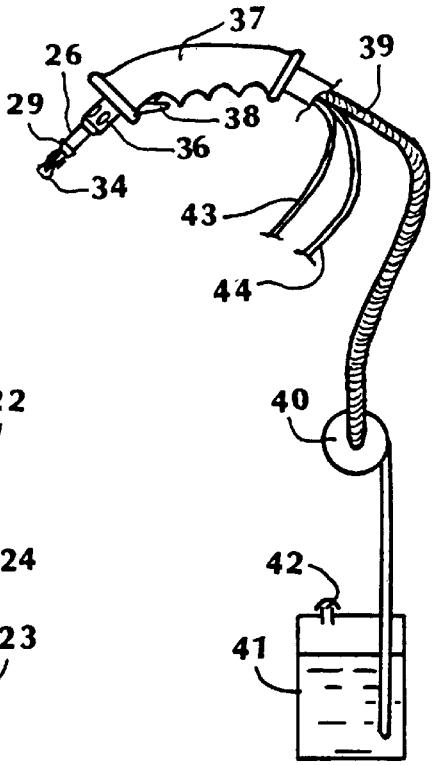
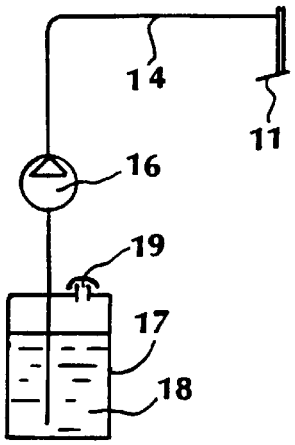
Fig.3
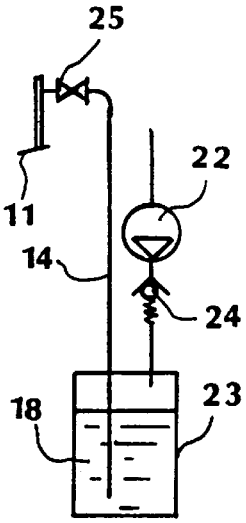
Fig.4
Fig.7

DEVICE FOR CLEANING METAL SURFACES

BACKGROUND OF THE INVENTION

1. Field of the Invention

The invention concerns a device for cleaning metal surfaces after they have been worked at high temperatures, that is, an apparatus with which scabs, oxidation or other marks left by high temperature treatment, such as the welding of metals and laser or plasma cutting, can be removed.

2. Description of the Prior Art

Prior art comprises a device consisting of a fibreglass pad wound around an electrode in the form of a nib. The pad is dipped into an acid solution of phosphoric acid (81% by weight), quinoline (0.01% by weight) and water and then placed near the surface that is to be treated: a power supply of low voltage alternate current is applied, with the ground conductor connected to the piece and the other connected to the metal part of the pad's support. The conditions of an electrolytic cell are thus created in the solution which can then remove the oxide or scab in a short time.

However, with this type of device, the operator is frequently hampered by technical difficulties with the maintenance and replacement of the insulating fibreglass material as, being exposed to very high temperatures, it can burn, and as a considerable quantity of dirt gets caught up in the fabric, hindering the development of suitable electric conditions, also as the pad must frequently be dipped into the acid solution: if it is not sufficiently damp, the material may become physically damaged and the electrolytic action is reduced.

Moreover, the residue remains firmly attached to the treated surface requiring several washes before being dried.

Furthermore, care has to be taken with the acid solution, which has a high density, to prevent it from dripping onto the operator or onto the floor when applied to vertical or underside surfaces.

Finally, it is not very practical for the operator to work next to a container filled with an acid solution and a great amount of the fibreglass insulating fabric that has to be wound around the nib of the electrode, in as much as work is not continuous, and thereby not productive, and it can also be dangerous.

Prior art also comprises a device for cleaning metals with fluid acid solutions—based on citric acid—which are constantly conveyed to the pad by means of an electric pump placed in the container of the acid solution.

However, owing to the low power levels employed and the low aggressiveness of the acid solution, this device has never been widely used in industry.

Furthermore, the metal electrode through which current flows and which is wrapped in the pad heats up because it is a good conductor of heat as well as of electricity: the increase in the electrode's temperature due to the accumulation of heat in the pad makes the acid solution evaporate quickly and can even cause the pad to burn, causing a short circuit between the electrode and the surface being treated. For this reason the pad has to be replaced relatively often.

Finally, none of the prior art devices protect the operator from the fumes generated during the cleaning process.

Such prior art may be subject to considerable improvement with a view to eliminating the said drawbacks, to increasing the safety of the device, its ease of use and to increasing the service life of the pad.

SUMMARY OF THE INVENTION

From the foregoing emerges the need to resolve the technical problem of inventing a new conformation of the device and a new means for applying the electrolytic action to remove the oxides, oxidation and scabs from metal surfaces, as well as a new conformation of the electrode and the pad with a view to eliminating the said burns.

The invention resolves the said technical problem by adopting a device for cleaning metals, comprising a pad of insulating material placed between the electrode and the metal surface to be cleaned, a low voltage alternate current power supply applied to the metal with the other electrode, an acid solution with which a pad soaked, the pad consisting of a tubular sheath or a strip of insulating material which is more than 1 mm thick, characterized in that the material with which the insulating fabric is made has been improved and consists of polyetheretherketone fabric (with trade name PEEK by Hoechst) and it is wrapped around the metal tip of the nib of electrode.

Also adopting: the said fabric of polyetheretherketone can also be used in the form of felt.

Also adopting: the said fabric of polyetheretherketone can also be used in the form of a mesh, coated with a layer of felt of any kind of insulating and heat resistant material, this layer being either applied directly at the time of production or at a later stage.

Also adopting: the said material of polyetheretherketone coated with a layer of felt, which can also be made of polyetheretherketone.

Also adopting: the said layer of felt being placed on the outer side of the layer of polyetheretherketone in relation to the nib.

Alternatively adopting: a device for cleaning metals, comprising a pad of insulating material placed between the electrode and the metal surface to be cleaned, a low voltage alternate current power supply applied to the metal with the other electrode, an acid solution with which a pad is soaked, consisting of tubular sheath or a strip of insulating material which is more than 1 mm thick, characterized in that there is a circuit for the supply of the acid solution by means of a manually or electrically driven pump which pressurizes the air in the tank above the free surface level of the acid solution and whereby the supply is controlled by a valve.

Alternatively adopting: a device for cleaning metals, comprising a pad of insulating material placed between the electrode and the metal surface to be cleaned, a low voltage alternate current power supply applied to the metal with the other electrode, an acid solution with which a pad soaked, consisting of tubular sheath or a strip of insulating material which is more than 1 mm thick, characterized in that, with a view to improving the safety of the device, there are slits on the electrode near the said pad, connected to a fan to suck up the gases and fumes formed during treatment.

Also adopting: an supply circuit for the acid, with which the very dense and aggressive acid is conveyed, by means of a hand pump or by some other means, from the acid tank which is made of an insulating material, that is, isolating the acid from the environment.

Also adopting: a metal nib, which is hollow or perforated axially, mounted inside the pad at the tip of the electrode to convey the acid.

Also adopting: the said nib wrapped in fabric of insulating material folded in two parts and fixed or kept in place with a ring made of an elastic, insulating or thermo-shrink-setting material; this elastic or insulating ring may be used again after having replaced the said pad made of folded material.

Also adopting: the said nib consisting of a metal body and of a replaceable extremity of insulating material inside which there is at least one metal body ending near the tip of the nib and which activates the electrolytic action.

Also adopting: the said replaceable extremity of the nib of metallic material coated with insulating material on the lateral walls so as to provide electrical continuity with the body of the nib at its area of contact and the non-insulated end surface. The said end surface has holes through which the acid solution is conducted.

Also adopting: the said insulating coating made up of a 0.1–0.3 mm thick layer of Teflon® for the prevention of short circuits and a 0.6–1.2 mm thick layer of Teflon for thermal insulation.

Finally, also adopting: the nib made of highly resistant stainless steel, that is, both the body and the replaceable metal extremity. The highly resistant stainless steel selected for the material of the nib preferably being AISI 316 stainless steel.

This invention has the following advantages: the operator can apply the acid directly and as often as necessary; even very aggressive solutions can thus be used, without wasting time dipping the pad and without wasting acid solution on the way from the container to the area to be treated. The pad soaks the acid up better and thus heats up less and wears out less through thermo-mechanical use. The nib of the electrode can have the most varied forms according to the particular working position; if the nib is tapered, the sheath can be replaced faster. The conveyance of the acid solution inside the pad avoids spilling acid or applying it where it is not needed. As the acid solution is not as concentrated and more fluid, and as cleaning is simplified due to the ease with which residual material is removed, treatment is more efficient and can be used for production on a large scale and costs are lower than with prior art techniques.

The service life of the sheath, even if made of fibreglass, is greatly increased with respect to that found with an entirely metallic electrode due to the insulating material used for the tip of the electrode or, even if this is made entirely of metal, due to the thick layer of insulating material.

Maximum service life can be obtained using a pad with a double layer: the inner one of fabric, such as polyetheretherketone, and the outer one of felt.

Maximum service life is obtained using polyetheretherketone, because it is extremely resistant to heat and acid. The outer felt layer, made of any suitable material such as the said fibreglass, keeps the solution on the area to be cleaned and enables it to adapt to the shape of the piece, thus greatly increasing the service life of the sheath. The use of sheaths with a double layer of polyetheretherketone, that is, for both the fabric and the felt, enables best results to be obtained as regards service life, precision and the quantity of work.

Considering the intensive wearing of the active tip of the nib, the replaceability of the tip of the nib allows the body of the nib to be made of normal stainless steel, whereas the tip can be made of special stainless steel which, though more expensive, does not wear out as quickly. As a consequence, the overall cost-effectiveness of the cleaning process is improved.

BRIEF DESCRIPTION OF THE DRAWINGS

Some embodiments of the invention are illustrated, purely by way of example, in the five tables of drawings attached in which FIG. 3 is a hydraulic circuit diagram of the pump for the acid solution; FIG. 4 is a hydraulic/pneumatic diagram of the pump pressurizing air in the acid tank, expelling the acid solution; FIG. 5 illustrates the section through a nib with a truncated-cone shaped metal insert and with sheath made of the improved insulating material. FIG. 6 is section VI—VI through the truncated-cone shaped metal insert; FIG. 7 is a diagram illustrating the intake and solution of the gases and fumes produced by heating the acid; FIG. 14 is a view of a nib having a brush made of insulating material to treat places which are difficult to access.

DETAILED DESCRIPTION OF THE DRAWINGS

Figure 1:
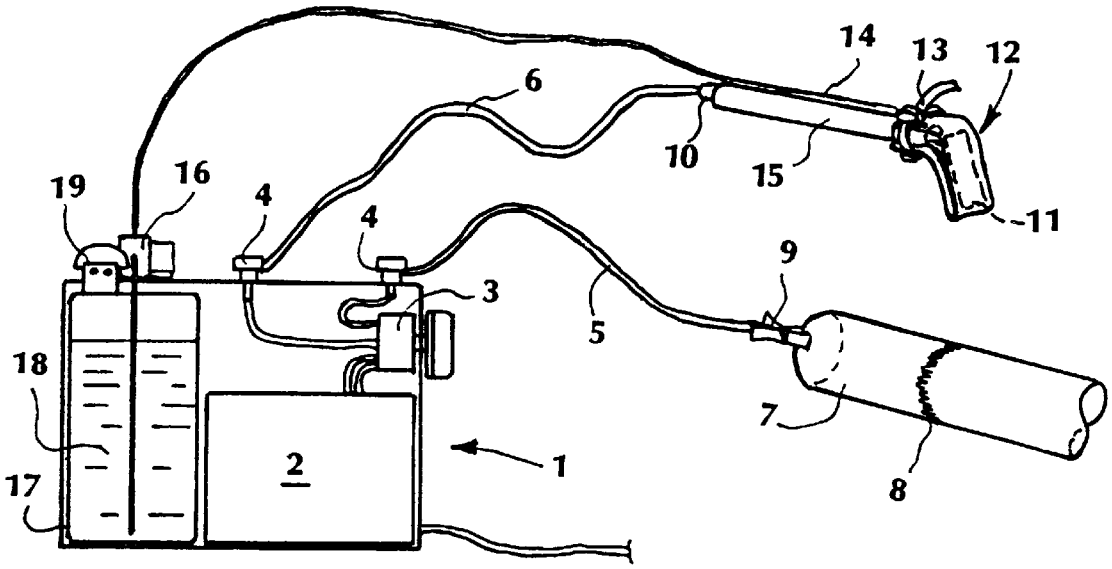
FIG. 1 is an overall view of the device equipped with acid supply circuit and with a fabric sheath of insulating material according to the invention.
Figure 2:
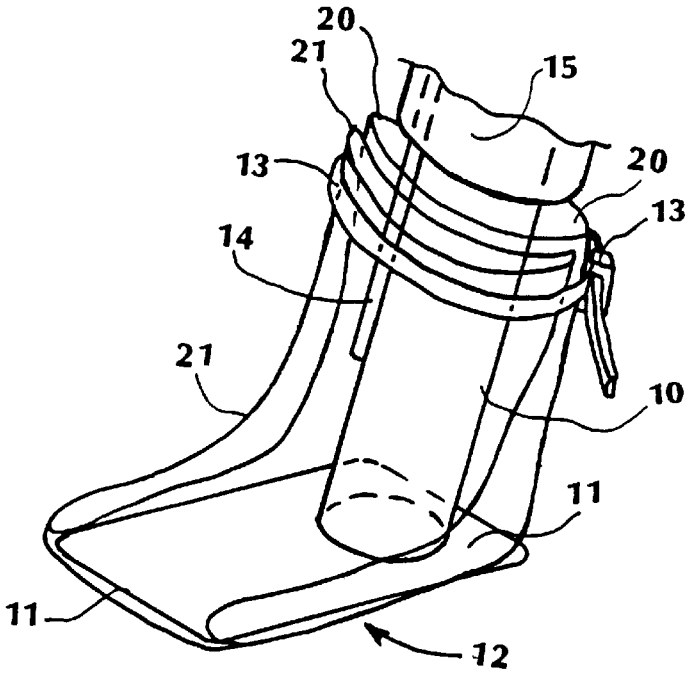
FIG. 2 is a magnified view of the nib of the pad wrapped in the sheath.

The figures show: 1, FIG. 1, the electric conveying apparatus made up of a transformer 2 to transform power supply current into low voltage current, a selector/breaker switch 3 to adjust the outgoing voltage, two clamps 4 for the conductors 5 and 6, one connected to the body 7 of the surface to be treated with pliers 9, and the other connected to the body 10 of the electrode which ends in nib 11, in turn wrapped in a sheath 12, kept in place by a clip 13; 14, a small tube to convey the acid solution, inside or outside the insulated handle 15, pumped by means of a pump 16 from the tank 17 which contains the acid solution 18 and which is insulated from the rest of the apparatus; 19, the lid of the tank with an air vent; 20, FIG. 2, the part of the fabric sheath made of insulating material covering the nib 11 and the extremity of the body 10 of the electrode; with 21, the sheath folded up over the point of the nib and held in place by clip 13; 22, a pump which compresses the air in the tank 23 and produces pressure that forces the acid solution 18 to flow in the small tube 14; 24, a no-return valve; with 25, a stop valve in the said small tube 14 fitted near the handle of the pad.

The figures also show: 26, FIG. 5, the extremity of the electrode with a truncated-cone shaped section 27, in which a hollow nib 28 is fitted, similarly equipped with a truncated-cone shaped extremity 29 and made flexible due to the longitudinal cut 30; 31, the internal tube which carries the acid solution and which is mounted on the said extremity of the electrode with seal 32 and which ends near the axial slit 33; 34, the fabric of insulating material fixed onto the said hollow nib with a ring 35 of elastic or thermo-shrink-setting material; 36, FIG. 7, slits made near the nib to suck up the gases and fumes produced during cleaning; 37, the anatomical handle with button 38 to activate the pump 16 or the valve 25; 39, a tube to suck up the said gases or fumes, connected to a centrifugal fan 40 which conveys gases into an appropriate moisture filter 41, after which the gases come out of the opening 42 clean; 43, the small tube in which the acid solution is conveyed, and 44, the electric conductor, equipped with a pair of wires to control the pump 16, if the latter is electric.

Figure 8:
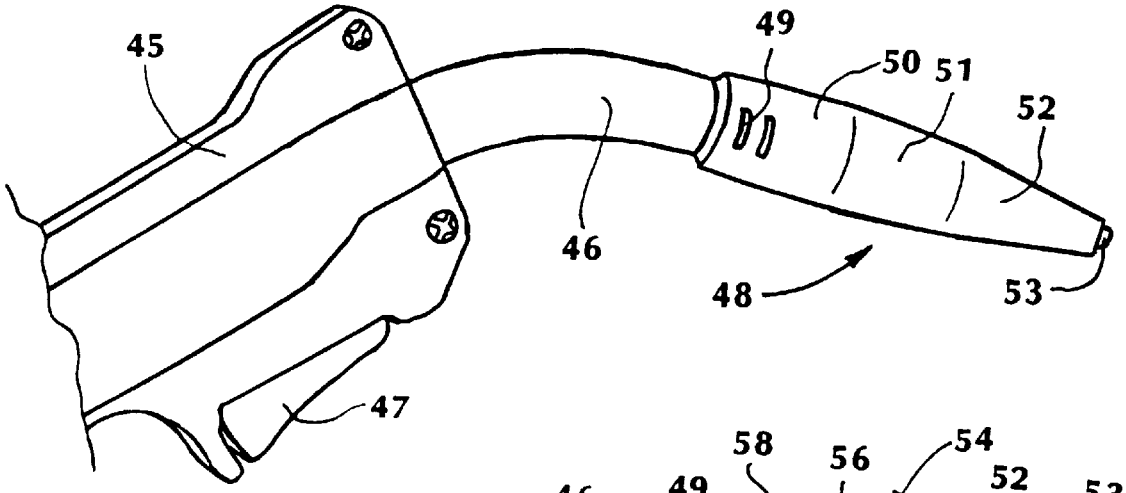
FIG. 8 is a partial view of a device with an improved replaceable, quick-release nib, which allows adaptation to the specific working position.
Figure 9:
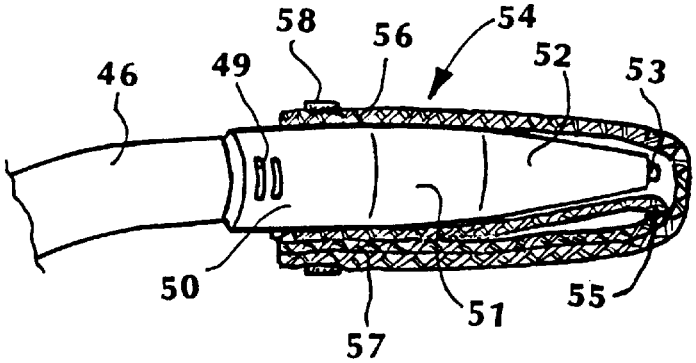
FIG. 9 shows the improved nib wrapped in the sheath of insulating material.
Figure 10:
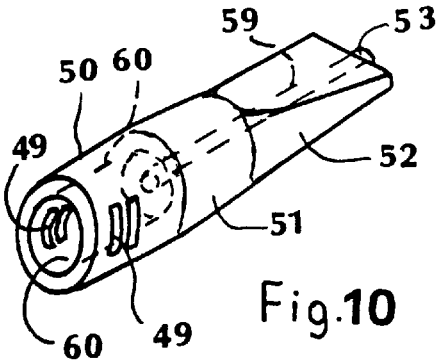
FIG. 10 is a rear view of the improved nib, illustrating the internal ducts.
Figure 11:
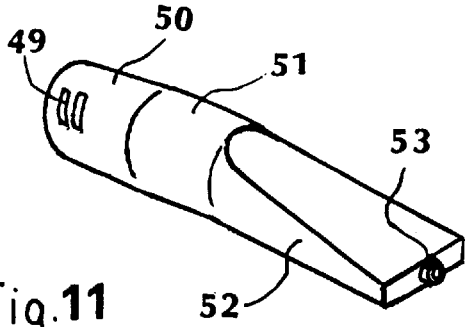
FIG. 11 is a front view of the said nib.
Figure 12:
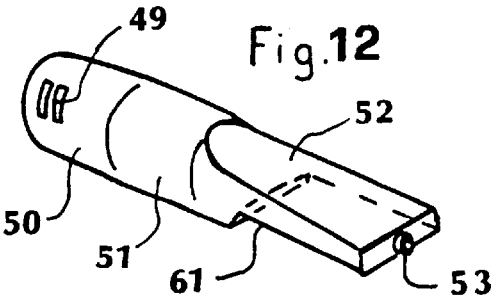
FIGS. 12 and 13 are views of two nibs especially designed to treat places which are difficult to access.
Figure 13:
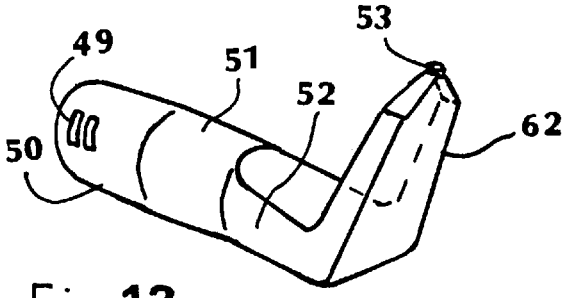

The figures also show: 45, FIG. 8, a standardized handle with a bent electrode body 46, control button 47, similar to button 38; 48, the nib with a bayonet-joint consisting of the slits 49 of the joint, of a first section 50 and of a second, slightly conical section 51 and of a tapering nib 52, which ends in open extremity 53 of tube for supplying the acid solution; 54 the sheath made of the fabric of insulating material 55 folded near the nib and fixed onto the tips 56 and 57 by means of the clip 58 or elastic element; 59, FIG. 10, the said opening of the tube for supplying the acid solution which is coupled to the electrode 46 in the ante-hole 60 in such a way that it is sealed and in which the solution flows; 61, FIG. 12, a flattening of the nib 52 which can hold the part of the folded sheath 54 of triple thickness and which enable tight recesses to be reached; 62, FIG. 13, a pointed and angled nib to treat internal corners; 63, FIG. 14, a thin, tapering nib with a fine brush 64 with stiffened bristles 65 of insulating material: the opening 59 conveys the acid solution to the middle of the brush.

Figure 15:
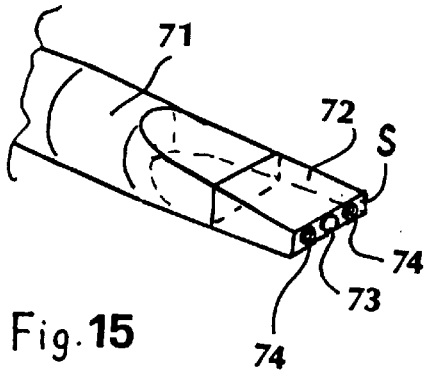
FIG. 15 is a view of the electrode equipped with a tip in insulating material in accordance with the invention.
Figure 16:
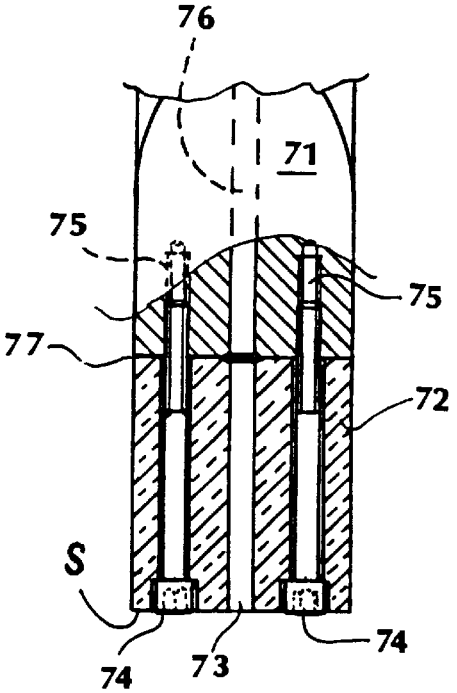
FIG. 16 is the enlarged section in a longitudinal plane of the nib of the electrode.

The figures also show: 71, FIG. 15, the body of the tapering metal nib which makes up the electrode; with 72 the tip of this nib of insulating material with an opening 73 to convey the acid solution to the sheath that makes up the pad, not shown for the sake of clarity; 74, the heads of the screws to fix it to this body, positioned near the end surface S: the stems of these screws extend to the corresponding threaded holes 75, FIG. 16; 76, the opening, through which the acid solution is conveyed into the said body; 77, the areas of contact between the body 71 and the tip 72: the flexibility of the material employed, that is, fibreglass-reinforced Teflon, is such that no seals need to be used. However, any leakage is collected by the fabric sheath of insulating material, not illustrated, and which fully envelops the said electrode.

Figure 18:
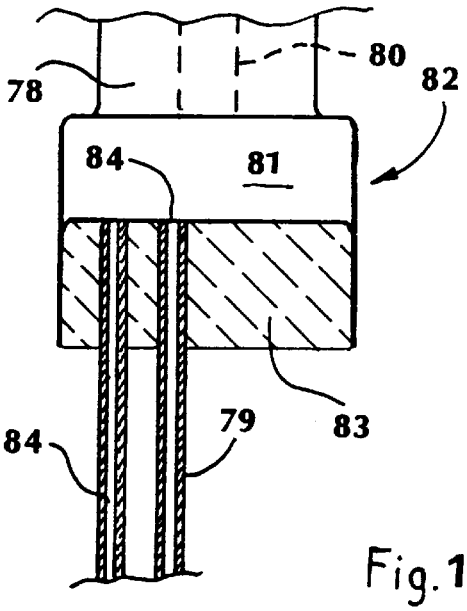
FIG. 18 is section F—F of FIG. 17, enlarged and limited to the two small thread-like tubes.
Figure 17:
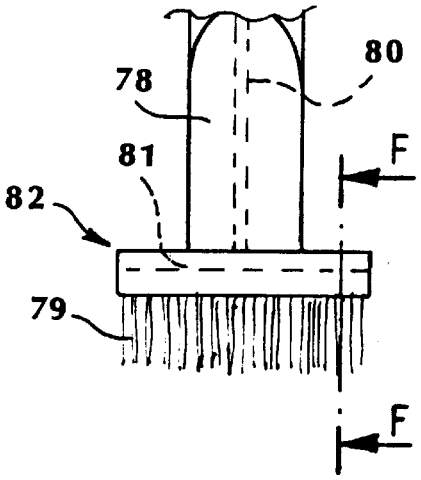
FIG. 17 is a view of a nib with a brush made of insulating material to treat places which are difficult to access.

The figures also show: 78, FIG. 17, the body of the electrode with a brush with small tubes of insulating material 79; 80, the opening through which the acid solution is conveyed into chamber 81, which is in the metallic head 82 of the brush in which the said small tubes are fitted; 83, FIG. 18, the block that hold said small tubes of insulating material. The figure only shows two small tubes, but they suitably cover the whole surface of the said head; 84, the openings of these small tubes, through which the acid solution is conveyed from the said chamber 81 into the metal recess to be cleaned.

Figure 20:
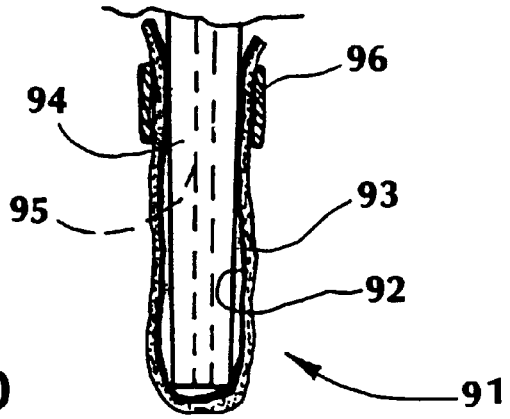
FIG. 20 shows the tip of the nib with its pad wrapped up in a double layer.
Figure 19:
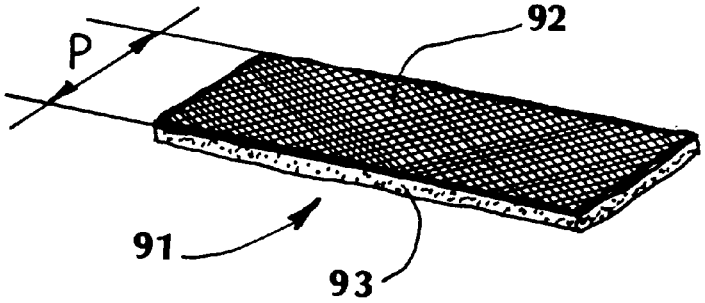
FIG. 19 is a view of a pad made up of a double layer of special material to wrap up the nib.
Figure 21:
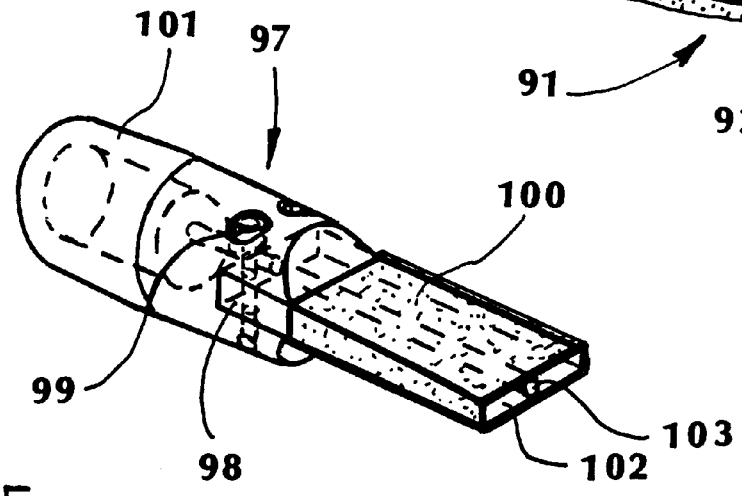
FIG. 21 is a view of a metal nib with a replaceable tip, which is fixed to the body by means of a screw and which is covered by a thick insulating layer.

Finally, the figures also show: 91, FIG. 19, the pad, made up of a layer of fabric of insulating material 92, possibly of polyetheretherketone, and a layer of insulating material of felt 93; P, the width of the strip of the pad, which is wider than the nib for which it intended; 94, FIG. 20, the tip of the nib seen from the side, around which the two sides of the pad illustrated in the preceding figure are wrapped, with the layer of material 92 on the inside and the layer of felt 93 on the outside; 97, a metal nib with a replaceable metal tip 98, which is fixed onto this nib by means of screws 99; 100, the insulating layer of the replaceable tip, which can be of a considerable thickness; 101, the thin layer, for protection against short circuits, on the body of the said nib 97; 102, the metal surface where wearing of the metal by the electrolytic cleaning is concentrated; 103, the opening to convey the acid solution.

The device for electrolytic cleaning of metal surfaces uses an acid solution with relatively small percentages of phosphoric acid (52.5% by weight) and quinoline (0.01% by weight) in water: the completely fluid acid solution, unlike the high density solutions used so far, enables the use smaller quantities of solution conveyed directly into the pad of the sheath 12 or 54 or of the pad 34 of the hollow nib 28, thus preventing the solution from dripping onto the surrounding areas and leaving relatively few and easily washable surfaces after cleaning, thereby enabling considerable savings to be made.

The solution is conveyed continuously so that the pad 12, 34 or 54 is always soaked.

The electrolytic action of the current flowing through the acid solution is remains constant, so the operator does not have to interrupt work to dampen the pad, but simply presses the button 25, 38 or 47 to convey the solution to the handle 37, 45.

The hydraulic circuit shown in FIG. 3 operates with a pump 16, which can be manual, operated directly by the operator by means of a small rubber pressure vessel, or driven by means of a low voltage electric motor: in the case of a system that works with air pressure, the tanks 17 or 27 are made of insulating material, in that the column of solution, as it is conveyed to the electrode, constitutes a live conductor from the electrode to the inside of the tank. The pneumatic-hydraulic circuit of FIG. 4 also operates by means of a pump 22, which can be manual, generating pressure in the tank 23; as the solution travels to the nib through valve 25, so the pressure in the tank decreases, making it necessary to regenerate the pressure by means of the said pump 22. The pressure can be maintained automatically with a pressure switch—not shown —that measures the pressure inside the said tank.

The tubular sheath 12, 54 made of a fabric of insulating material is mounted by introducing the first tip 20, 56 into the nib 11, 52 until it fully covers it. The sheath is twice as long, so that it can be folded with the other end 21, 57 in the same position as the first tip. The clip 13, 58 is placed in such a way as to fix both tips at the same time onto the body of the nib 11, 48.

The hollow nib 28, which is equipped with a fixed layer of fabric of insulating material 34 mounted beforehand, is fitted or replaced in a similar but easier way. This nib is pressed onto the conical element 27 of the tip 26 of the electrode, with its truncated-cone-shaped extremity 29. It is replaced in a similar way by completely removing the said nib and fitting another nib. The hollow nib with a truncated-cone shaped ratchet can take on various forms, as can be seen from the nibs in FIGS. 12 and 13 or with the brush in FIG. 14.

The snap-fit nibs have a seal between the ante-opening 60 and the bent electrode 46 to prevent leakage of the acid solution and to convey it to the opening 59 with no waste. With the flattened shape 61 illustrated in FIG. 12, the nib can have a tubular-shaped sheath folded in the said flattening in such a way as to be much thinner than with the normal nib 48. Finally, the pointed and angled shape 62 of the nib makes it possible to reach recesses and corners in tight places which are difficult to access.

Furthermore, the nibs can have a screw-fit joint instead of a snap-fit joint.

Nibs 63 fitted with a brush 64 with bristles of insulating material 65 are used by running them longitudinally or transversally over the butt-weld, the said bristles, stiffened with a coating of Teflon or similar material, being able to reach the bottom of the notch between the wall and the butt-joint and can clean it thoroughly.

The pistol with the slits 36 to suck up the gases and fumes enables the operator to work without danger. The air that is sucked up, which contains the gases and fumes, is conveyed through the moisture filter 41, which is adapted according to the products used to clean metal surfaces with acid solutions.

While cleaning, the tip 72 does not conduct the electric current: this occurs instead through the heads of the screws 74 which are fitted so that they are parallel with the surface at the end of the tip S. The current is conducted from these screw heads to the sheath soaked in the acid solution, thus activating electrolytic cleaning. As the tip 72 does not conduct electricity, it does not heat up during the electrolytic action of the sheath on the surface to be treated, and, consequently, the sheath is not irreparably damaged by burning.

The electrode with the body 78 fitted with a brush made up of small tubes 79 of insulating material operates by conducting the electric current into the acid solution from the said metal body 78 to the surface of the notch to be treated, getting at the inner-most corners of this recess.

Tests carried out with the tip of the electrode made of fibreglass-reinforced Teflon have shown that the sheath has a service life which is longer than the common sheaths with tips made entirely of metal, by approximately a work shift.

The pad 91, improved with a double-layered material 92, 93, the outer layer of which is made of felt 93, is used by wrapping up the tip of the nib and holding the pad with a fastening ring 96. The pad does not necessarily overlap the side of the tip perfectly, whilst the middle part of the said pad covers the active area 102 of the metal tip 98, the insulating coating 100, preferably consisting of a 0.6–1.2 mm thick layer of Teflon®, avoids electrolytic action at the sides of the tip, whereas the totally uncovered face is the means for the said action. Less advantageously, the tip may be coated only by a thin layer of insulating material, for example a 0.1–0.3 mm-thick layer of Teflon, which also protects it from damage and short circuits on the sides, as is the case for the body of the nib 97 with the coating 101.

Even though it is possible to use various insulating materials for the two layers 92, 93 of the said pad, the double-layered pad 91 lasts longest if the inner layer 92 of the material is made of polyetheretherketone and the outer layer 93 is made of polyetheretherketone felt. The double-layered strip can be produced by joining the two layers afterwards or by placing one layer over the other directly at the time of production.

The worn pad can easily be replaced by removing the fastening ring 96 and changing the strip at the tip of the pad. The ring 96 of insulating material can be re-used a number of times.

After the metal tip 98, equipped with a thick insulating layer 100, or even not so thick, is worn out and can no longer fulfill its cleaning function as well as required, it is replaced by removing the screws 99.

The longest service life for the metal tip of the nib is achieved using stainless steel of AISI 316 quality; with all other types of stainless steel, costs are reduced, but wear is increased.

With prior art devices the technical problem of wear did not arise due to the low power levels employed and consequently the low productivity achieved with these devices.

In practice the materials, dimensions and details of execution may differ from, but be technically equivalent to, those indicated without departing from the juridical domain of the present invention.

We claim:

1. Device for electrolytic cleaning metal surfaces of a workpiece using an acid solution after they have been worked at high temperatures, said device comprising: a fabric pad of insulating material adapted for placement between a metal tip of a nib of a first electrode (10) and a metal surface (8) to be cleaned, a low voltage alternate current power supply (2) adapted for application to the metal surfaces (7) through a second electrode (9); said pad being of a tubular sheath (12) or a strip of an insulating polyetheretherketone fabric of more than 1 mm thick covering said metal tip of said nib of said first electrode; wherein said pad is arranged to be supplied with the acid solution.

2. A device for cleaning metals, as claimed in the previous claim 1, wherein said polyetheretherketone fabric is in the form of felt.

3. A device for cleaning metals, as claimed in claim 1, wherein said polyetheretherketone fabric is coated with a felt layer of heat-resistant insulating material.

4. A device for cleaning metals, as claimed in claim 3, wherein said polyetheretherketone fabric is in the form of a mesh coated with a felt layer made of polyetheretherketone.

5. Device for cleaning metals, as claimed in claim 3, characterized in that the said layer is in the form of felt (93) placed on the outside of the layer of material (92) of polyetheretherketone in relation to the nib (94).

6. A device for cleaning metals, as claimed in claim 1, wherein said nib is mounted on the tip of the electrode and is either hollow or axially perforated, and through which the acid solution is may be conveyed.

7. Device for cleaning metals, as claimed in previous claim 1, characterized in that the said nib is wrapped in fabric made of insulating material which is folded in such a way as to from two parts (34, 91) and is fixed or held in place by a ring (35, 96) of elastic, insulating or thermo-shrink-setting material; it being possible to re-use the said elastic or insulating ring many times after replacing the pad of folded fabric.

8. Device for cleaning metals, as claimed in claim 1, characterized in that the said nib consists of a metal body (71) and a replaceable tip of insulating material (72), which has inside it at least one metallic element (74) with an extremity near the tip (S) of the nib and which may activate electrolytic action.

9. Device for cleaning metals, as claimed in claim 8, characterized in that the said replaceable tip (94, 98) of the nib (97) is made of a metallic material coated with an insulating material (100) on the lateral walls so that there is electric continuity in the area of contact with the body of the nib and on the uninsulated end surface (102); the said end surface has holes (103) through which the acid solution may be is conveyed.

10. Device for cleaning metals, as claimed in claim 9, characterized in that the said insulating layer (101) consists of a 0.1–0.3 mm-thick layer of polytetrafluoroethylene for protection against short circuits.

11. Device for cleaning metals, as claimed in claim 10, characterized in that the said insulating layer (100) consists of a 0.6–1.2 mm-thick layer of polytetrafluoroethylene for thermal insulation.

12. Device for cleaning metals, as claimed in previous claim 8, characterized in that the material of which the nib is made, is a highly resistant stainless steel.

13. Device for cleaning metals, as claimed in claim 12, characterized in that the replaceable tip is made of high strength stainless steel AISI 316.

14. A device for electrolytic cleaning metal surfaces of a workpiece using an acid solution after they have been worked at high temperatures, said device comprising: a fabric pad of insulating material adapted for placement between a first hand-holdable electrode (10) and a metal surface (8) to be cleaned, a low voltage alternate current power supply (2) adapted for application to the metal surface (7) through a second electrode (9); said pad being a tubular sheath (12) or a strip (34, 91) of a fabric of insulating material more than 1 mm thick; a circuit with a pump connected to a tube (14) and a stop-valve (25) for supplying said pad with the acid solution from a separate tank (23).

15. A device for electrolytic cleaning metal surfaces of a workpiece using an acid solution after the surfaces have been worked at high temperatures, said device comprising: a fabric pad of insulating material adapted for placement between a tip of a first electrode and a metal surface to be cleaned, a low voltage alternate current power supply adapted for application to the metal surface through a second electrode; said pad being a tubular sheath or a strip of a fabric of insulating material more than 1 mm thick; and slits on said first electrode near said pad connected to a fan adapted to evacuate gases and fumes formed during the cleaning of metal surfaces; wherein the evacuation of the gases and fumes improves the safety in the usage of the device.

16. A device for cleaning metals, as claimed in claim 7, further comprising a supply circuit to convey the acid solution, by means of a pump, from a tank that is adopted to contain the solution.

* * * * *